US005368455A

United States Patent [19]

Eisenmann

[11] Patent Number: 5,368,455

[45] Date of Patent: Nov. 29, 1994

[54] GEAR-TYPE MACHINE WITH FLATTENED CYCLOIDAL TOOTH SHAPES

[76] Inventor: Siegfried A. Eisenmann, Conchesstrasse 25, 7960 Aulendorf, Germany

[21] Appl. No.: 990,195

[22] Filed: Dec. 14, 1992

[30] Foreign Application Priority Data

Jan. 15, 1992 [DE] Germany ..... 4200883

[51] Int. Cl.[5] ..... F01C 1/10

[52] U.S. Cl. ..... 418/171; 418/150; 418/190

[58] Field of Search ..... 418/171, 150, 190, 166

[56] References Cited

U.S. PATENT DOCUMENTS

| | | | |
|---|---|---|---|
| 2,344,628 | 3/1944 | Monahan | 418/190 |
| 4,922,781 | 5/1990 | Peiji | 418/171 |
| 5,163,826 | 11/1992 | Cozens | 418/150 |
| 5,226,798 | 7/1993 | Eisenmann | 418/171 |

FOREIGN PATENT DOCUMENTS

| | | |
|---|---|---|
| 3938346 | 4/1991 | Germany . |
| 233423 | 5/1925 | United Kingdom . |

OTHER PUBLICATIONS

Myron R. Hill, Kinematics of Gerotors, Second Edition, Chapter VIII, published by *The Peter Reilly Company,* Philadelphia, pp. 9–11 and 39–43.

*Primary Examiner*—Richard A. Bertsch
*Assistant Examiner*—Charles G. Freay
*Attorney, Agent, or Firm*—Armstrong, Westerman, Hattori, McLeland & Naughton

[57] ABSTRACT

In a gear-type machine, in particular in a ring gear pump with internally toothed ring gear meshing with a pinion having only one tooth less, for reducing the noise the pinion teeth are only half as wide as the internally toothed ring gear teeth and the cycloids are flattened in order to ensure adequate free passage of the teeth heads opposite the point of deepest teeth engagement in spite of minimum clearance.

11 Claims, 3 Drawing Sheets

GEAR-TYPE MACHINE WITH FLATTENED CYCLOIDAL TOOTH SHAPES

BACKGROUND OF THE INVENTION

1. Field of the Invention

The invention relates to a gear-type machine for liquids or gases comprising a housing containing a gear chamber having inlet and outlet openings, an internally toothed ring gear arranged in the gear chamber and a pinion which is rotatably arranged within the ring gear in the housing and which has one tooth less than the ring gear, meshes with the latter and on rotation forms between its teeth and the teeth of the ring gear revolving, expanding and diminishing fluid cells which conduct fluid from the inlet to the outlet, the teeth heads of the pinion and the teeth gaps of the ring gear having the form of epicycloids which are formed by rolling of a first generating circle on the pitch circle of the pinion and ring gear, the teeth gaps of the pinion and the teeth heads of the ring gear furthermore having the form of hypocycloids which are formed by rolling of a second generating circle on the pitch circle of the pinion and ring gear respectively, and finally the radius of the first generating circle being different to the radius of the second generating circle.

The gear-type machine according to the invention may be used both as pump for liquids or gases and as motor driven by pressurized liquids or gases. However, the preferred field of use of the invention is as liquid pump. In the following description and in the claims, for the sake of simplicity, reference will be made only to fluids, meaning preferably liquids. In the claims the term fluid is therefore likewise intended to cover gases and liquids as well.

The following explanation of the invention will be made solely with reference to a pump for liquids.

The gear-type machine according to the invention may be one in which the ring gear is fixedly arranged in the housing, the pinion then rotating about the crank arm of a shaft which is arranged centrally with respect to the internal toothing of the pinion. However, the machine according to the invention is preferably one in which the ring gear revolves in the gear chamber and the pinion mounted eccentrically with respect to the axis of the ring gear and gear chamber rotates with a stationary shaft or about such an axis. The main field of use of the invention is as a machine constructed as internal ring gear pump for lubricating or hydraulic fluid for internal-combustion engines and automatic transmissions where delivery pressures of up to a maximum of 30 bar can occur. For this use, in which the pump pinion is preferably arranged in an extension of the crankshaft of the engine or the main shaft of the gearbox or is carried by said shaft, internal ring gear pumps have proved to be quiet low-vibration pumps. However, due to the constantly improving quietness of engines and transmissions constantly higher demands are being made on the quietness of such pumps.

2. Description of the Prior Art

Most known constructed internal gear-type pumps or ring gear pumps for internal-combustion engines and automatic motor vehicle transmissions operate with trochoid toothings in which the teeth flanks of the hollow gear or the pinion are limited by circular arcs and the counter wheel is defined by non-slip rolling in the toothing of the other wheel fixed by the arcs.

Gear-type pumps of the type improved by the invention have been known for a long time, for example from GB-PS 233,423 of the year 1925, or the publication "Kinematics of Gerotors" by Myron S. Hill, likewise originating in the twenties. The modern use of cycloid toothing for the aforementioned purpose in internal-combustion engine and automatic transmissions is described in Applicants' DE-PS 3,938,346. The pump according to this German patent employs the excellent kinematic properties of teeth and teeth gaps having a complete cycloid contour in an internal ring gear pump with a teeth number difference of one for mounting the ring gear with its toothing on that of the pinion which is carried by the crankshaft of the engine or the main shaft of the automatic gearbox. In this manner the relatively pronounced radial movement of the crankshaft can be compensated in that the peripheral mounting of the ring gear is chosen with adequate clearance for this compensation. It is equally possible to mount the ring gear with little play and then provide a correspondingly large play between the shaft bearing the pinion and the pinion, the pinion then being mounted with its toothing in that of the ring gear.

Such pumps represent a preferred field of use of the present invention.

For the undesired noise development and the resulting drop in efficiency of the known pumps, pressure pulsations, i.e. delivery flow pulsations, are primarily responsible, as well as the knocking of the teeth together in the radial and tangential direction. The delivery flow pulsations are intensified by squeeze oil pressure peaks which lead to oscillations in the gear running set. Cavitation noises also act in the same sense; they arise primarily due to the breaking down of liquid vapour bubbles in the region of the pressure chamber of the pump.

SUMMARY OF THE INVENTION

The invention therefore has as its object in particular to make the known ring gear machines quieter, i.e. reduce the noise development, which represents a substantial advantage when these machines are used as lubricating oil pumps in motor vehicle drive and transmission aggregates. A further advantage achieved by this noise reduction is the increase in the efficiency and the lengthening of the life of the ring gear machine.

The invention therefore proposes in a gear-type machine (pump or motor for liquids or gases) comprising a housing containing a gear chamber having inlet and outlet openings, an internally toothed ring gear arranged in the gear chamber and a pinion which is rotatably arranged within the ring gear in the housing and which has one tooth less than the ring gear, meshes with the latter and on rotation forms between its teeth and the teeth of the ring gear revolving, expanding and diminishing fluid cells which conduct fluid from the inlet to the outlet, the teeth heads of the pinion and the teeth gaps of the ring gear having the form of epicycloids which are formed by rolling of a first generating circle on the pitch circle of the pinion and ring gear, the teeth gaps of the pinion and the teeth heads of the ring gear having the form of hypocycloids which are formed by rolling of a second generating circle on the pitch circle of the pinion and ring gear respectively, and the radius of the first generating circle being different to the radius of the second generating circle, the improvement in which the peripheral extent, measured on the respective pitch circle, of the pinion teeth gaps defined by hypocycloids and ring gear teeth is 1.5 times to 3 times the peripheral extent, measured on the respective pitch circle, of the pinion teeth defined by epicycloids and the ring gear teeth gaps and the epicycloids and the hypocycloids are flattened towards their pitch circles to such an extent that the sum of the two flattenings corresponds to the necessary, relatively large radial clearance between the teeth heads at the point opposite the point of deepest teeth engagement, whereas the gears mesh together at the point of deepest teeth engagement with very small clearance.

The first feature mentioned can also be formulated by stating that the radius of the generating circle generating the hypocycloids is equal to 1.5 times to 3 times the radius of the generating circle generating the epicycloids.

In the reduction of the ring gear machine noise to a minimum, the invention assumes that, at least with precise production and small clearance, the delivery flow pulsations in ring gear machines of the type according to the invention are primarily, caused by the profile of the instantaneous displacement volume. This in turn depends primarily on the position of the sealing points between the pressure space and the suction space of the machine over the angle of rotation of the pinion or ring gear. Thus, theoretically, with a perfect meshing free from clearance, the sealing points coincide with the intersection points of the teeth flanks with the teeth engagement line. The sealing points in the region above the pressure and suction openings are of no consequence because there the fluid cells separated by the sealing points are in any case interconnected by the suction and pressure openings. Thus, only the position of the sealing points in the region of the deepest teeth engagement and in the region opposite said point are decisive. The theoretical engagement line is made up in ring gear machines of the type according to the invention from three circles contacting each other at the intersection of the pitch circles and the straight line connecting the two gear centre points, said circles being symmetrical to the connecting straight line of the two gear centre points and bisected by said line.

Optimum engagement conditions in the region of the deepest teeth engagement (top of FIG. 1) of primary importance here is obtained by the cycloid toothing employed in the invention. However, this is only the case when the clearance is very small at this point. The reduction of the teeth clearance is however limited among other things because it is not possible, without excessive technical expenditure for mass production, to set beneath a certain measure of unroundness of the ring gear. As a result of this, in the prior art the minimum clearance or play must always still be large enough to prevent a metallic contact between the pinion teeth tips and the ring gear teeth tips opposite the point of deepest teeth engagement (at the bottom in FIG. 1). The clearance necessary to ensure that the teeth mesh freely Opposite the point of deepest engagement in turn leads to the "minimum teeth clearance" still being relatively large in the known toothings. This itself results in the profile of the path of the sealing point in the region of the deepest teeth engagement considerably differing from the theoretical profile. To permit tile minimum possible teeth clearance in this region with a large teeth clearance in the region opposite, the invention further proposes that either the cooperating teeth gaps of the ring gear and teeth of the pinion or the cooperating teeth of tile ring gear and the gaps of the pinion are flattened to such an extent that the teeth tips in the region opposite the point of deepest teeth engagement are reliably free from each other. The flattening of the teeth therefore achieves the relatively large teeth clearance in the region opposite the point of deepest teeth engagement. The flattening of the teeth gaps by the same amount compensates the resulting increase in the teeth clearance in the region of the deepest teeth engagement.

Of course, the flattening can also be distributed amongst the two aforementioned cycloid groups, i.e. the epicycloids and the hypocycloids. It is however simpler to restrict it to one of the two groups.

As a result, the gears can in fact mesh with minimum clearance in the region of deepest teeth engagement and approximate very exactly theoretical maximum values. This reduces to a minimum any unfavourable influence of the deviation of the sealing points between meshing teeth in the region of the point of deepest teeth engagement. The negative influence of such a deviation on the delivery flow pulsation is thereby reduced.

However, the delivery flow pulsation is reduced to a particularly great extent by the teeth thickness ratio chosen according to the invention. As extensive tests have shown, the delivery flow pulsation, that is the fluctuation of the throughout per unit time, is not independent of the selected tooth profile, which can be changed particularly easily with a cycloid toothing by changing the ratio of the tooth thicknesses of the internal ring gear and pinion with respect to each other, without thereby losing the advantages of the cycloid toothing. This fact is utilized in the solution according to the invention. If the fluctuation of the instantaneous displacement volume, i.e. the quotient of the difference of the maximum displacement volume and the minimum displacement volume and the mean displacement volume, is plotted over the ratio of the widths of the hollow gear tooth and the pinion tooth, a minimum is obtained in the region between tooth width ratios of 1.5 and 3 for the irregularity of the instantaneous displacement volume.

The configuration is even more favourable when the peripheral extent of the pinion teeth gaps and ring gear teeth is made 1.75 to 2.25 times as great as the peripheral extent of the pinion teeth and the ring gear teeth gaps.

The conditions become optimum when the pinion teeth are made half as thick as the ring gear teeth, i.e. the generating circle generating the epicycloids is made half as large as the generating circle generating the hypocycloids.

Preferably, in the flattening of the teeth profiles only one of the two groups of cycloids is flattened, i.e. either the epicycloids or the hypocycloids, in order to obtain the full extent of the necessary clearance, whilst the flattening of the other cycloid group is equal to zero. Here, it is again preferable for the epicycloids to be flattened.

It is of course essential in the flattening that both the flattening of the teeth gaps and the flattening of the teeth heads cooperating with said teeth gaps obey the same mathematical law. The flattening may for example be obtained in that the radial height of the teeth and the radial depth of the gaps of the counter gear cooperating with said teeth is reduced by a slight amount which decreases progressively to zero from the tooth centre or the tooth gap centre up to the intersection of the tooth colander with the pitch circle. However, this represents a deviation from the optimum cycloid profile. The simplest solution is a flattening obtained by a slight radial displacement of the point describing the cycloids from the periphery of the generating circle in the direction to the centre thereof. The cycloid contour is thus retained.

Although this results in a small gap of the order of magnitude of a minute fraction of a millimetre between the starting point of the flattened cycloids and the corresponding foot point of the unflattened cycloids on the pitch circle, said gap can be advantageously overcome in that the starting point and the end point of the flattened cycloids is connected by a straight line to the starting point or end point of the unflattened cycloids on the pitch circle.

Since the flattening of the cycloids is of course only a minimum correction of the reduction of the clearance, already kept as small as possible, it suffices for the sum of the two cycloid displacements (as stated above, the one displacement can be equal to zero and preferably is) measured in the cycloid centre is the 2000th to 500th part of the pitch circle diameter of the ring gear.

In the case of relatively large ring gear diameters said sum will be made 1000th whilst with small ring gear diameters this can be increased to a 500th. It is seen from this that for example with a ring gear pitch circle diameter of 100 mm the sum of the two cycloid flattenings and thus also the distances of the starting points of the flattened cycloids from the associated pitch circle is of the order of only 0.1 mm.

Nevertheless, these flattenings achieve that in the region of the deepest teeth engagement the two gears can mesh almost free from clearance whereas opposite said point a clearance of the order of magnitude of a maximum of 0.1 mm is kept free between the teeth tips and in certain angular positions of the gears can approach zero for compensating lack of trueness in the ring gear and possibly also in the pinion at the point of minimum diameter.

Although according to the invention the teeth clearance at the point of deepest engagement can be exceedingly small, it must not of course be zero. The necessary minimum tooth flank clearance here in the peripheral direction can be obtained by an equidistant reduction of the tooth contour. The magnitude of this reduction may for example be $10^{-4}$ times the diameter of the ring gear pitch circle. It is seen from this number how small the teeth clearance necessary in the invention is.

With increasing number of teeth, the delivery flow pulsation of course decreases in ring gear machines; this also unfortunately applies to the delivery flow itself. The aim is therefore to keep the number of teeth in the ring gear machine as low as possible without having to accept excessive delivery flow pulsation and other disadvantages by an unacceptably low number of teeth. Accordingly, the number of teeth of the pinion is advantageously chosen between 7 and 11.

To prevent the influence of abrupt fluctuations of the pressure in the delivery flow of liquid pumps which might arise due to collapse of vapour bubbles caused by cavitation in the liquid delivery flow, at least and preferably in the pinion a narrow axial groove can advantageously be provided in the teeth gap bottom.

The grooves are advantageously about one quarter to one sixth as wide as the generating circle periphery, preferably one fifth thereof.

The grooves are advantageously 2 to 3 times as wide as they are deep.

The axial grooves in the bottom of the pinion teeth gaps ensure a certain dead space without however impairing to a troublesome extent the optimum filling of the teeth gaps by the teeth heads of the ring gear and thus also the optimum guiding of the gears on each other and therefore the excellent sealing between the teeth. In the dead space thus generated cavitation bubbles filled with vapour of the operating liquid and squeeze oil can collect without the bubbles being forced to collapse faster by the function of the pump or motor. Since due to their low mass the cavitation bubbles collect under the influence of gravity near the teeth bottoms of the pinion, the in effect negative action of the dead space of the grooves provided according to the invention is reduced to a negligible remaining minimum.

The guidelines for the dimensioning of the grooves given above assume that too narrow grooves have too small a takeup capacity whilst too deep grooves impair the strength of the pinion and too wide grooves again impair the cooperation of the gear contours.

Giving the grooves a rectangular profile has the advantage of a relatively large takeup capacity; if they are given a highly rounded profile, for example a circular arc profile, the advantage of the minimum possible weakening of the pinion strength is obtained. In the case of rectangular grooves the edges between the side walls and the bottom of the grooves are advantageously rounded in order to avoid notch effects. The edges between the side walls of the grooves and the adjoining teeth gap bottom can also advantageously be made angular to retain as far as possible the full loadbearing capacity of the teeth gap bottom. These edges should however not be sharp edges.

According to an advantageous further development of the invention the grooves are also, provided in the teeth gap bottom of the internal ring gear. Here, the grooves can admittedly not take up any cavitation bubbles but can take up squeeze oil, which in many cases is advantageous. These grooves can usually be made smaller than those in the teeth gap bottom of the pinion.

Seen in axial section the grooves may for example have a circular arc profile. For manufacturing reasons, however, it is preferable for the grooves to pass over the entire tooth width with constant profile.

The groove arrangement described can of course also advantageously be employed in gear-type machines of different category to that described so far; they are even suitable for gear-type machines with filling piece, i.e. in which the difference in the number of teeth is greater than 1.

BRIEF DESCRIPTION OF THE DRAWINGS

Hereinafter the invention will be explained in detail with the aid of the drawings, wherein.

DESCRIPTION OF THE PREFERRED EMBODIMENTS

Figure 1:
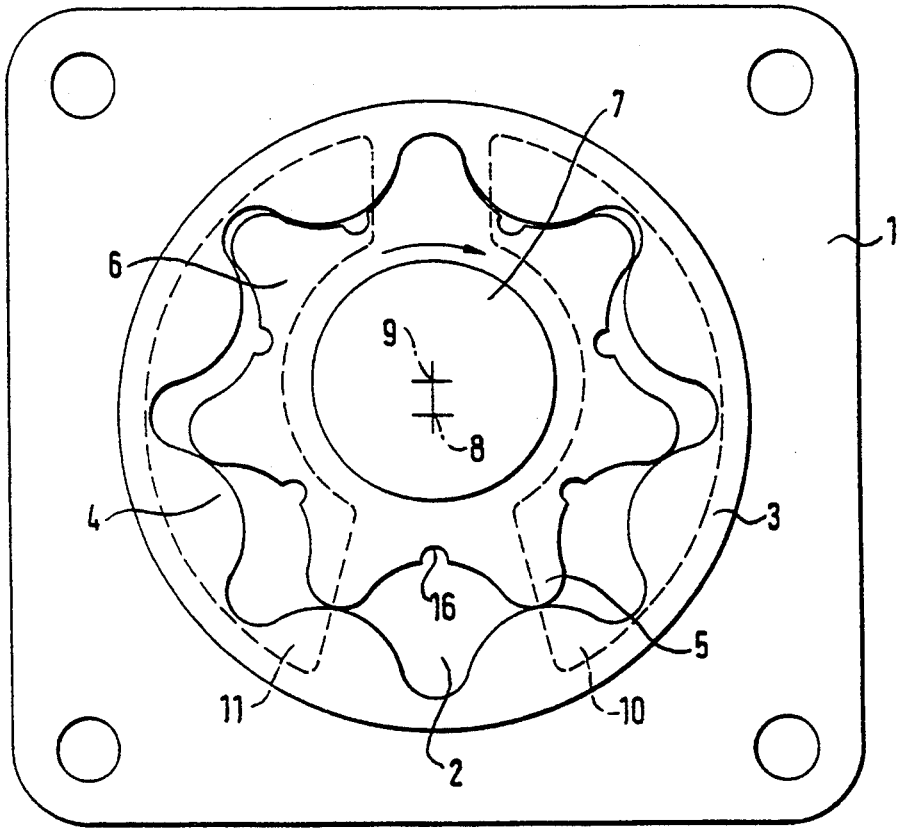
FIG. 1 shows schematically the view of a ring gear pump according to the invention, the cover being omitted so that the gear chamber with the gears can be seen.

The ring gear pump shown in FIG. 1 has a housing 1 in which a cylindrical ring gear chamber 2 is Cut out. On the peripheral surface of the ring gear chamber 2 the ring gear 3 is rotatably mounted with its cylindrical peripheral surface. The ring gear 3 has eight teeth 4. Said teeth mesh with the teeth 5 of the pinion 6 which is mounted non-rotatably on a shaft 7 driving the pinion. The axis of rotation of the hollow gear 3 is denoted by 8; that of the pinion 6 is denoted by 9. As indicated by the arrow in FIG. 1 the pump revolves clockwise. It has an intake opening 10 and an outlet opening 11. The contours of these two openings lie in FIG. 1 behind the gears and are therefore shown in dashed line.

The inlet and outlet passages to the inlet opening 10 and from the outlet opening 11 are not shown in FIG. 1, for the sake of clarity.

The pump is generally known to the extent to which it has been described so far in the description of the Figures.

Except for the flattening of the cycloids, the ratio of the pinion tooth width to the internal ring gear tooth width and the grooves 16 in the bottom of the pinion teeth gaps, the pump illustrated corresponds to a pump according to German patent 3,938,346 or U.S. patent application Ser. No. 593,135 of Oct. 5, 1990.

Figure 3A:
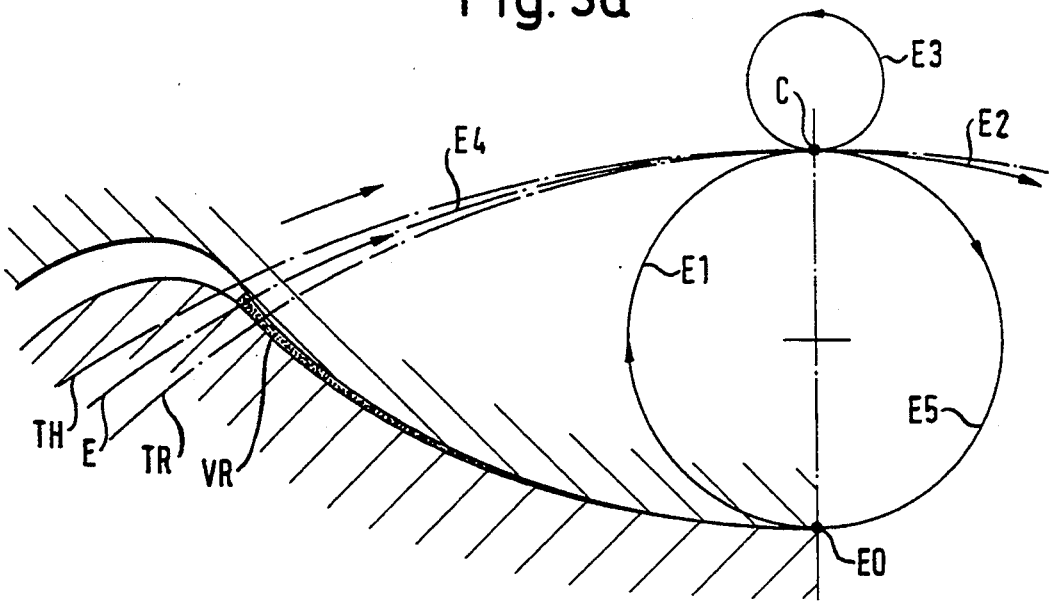
FIG. 3*a* shows the left half of an ideal play-free toothing according to the invention at the point of deepest teeth engagement, to a still greater scale.
Figure 4:
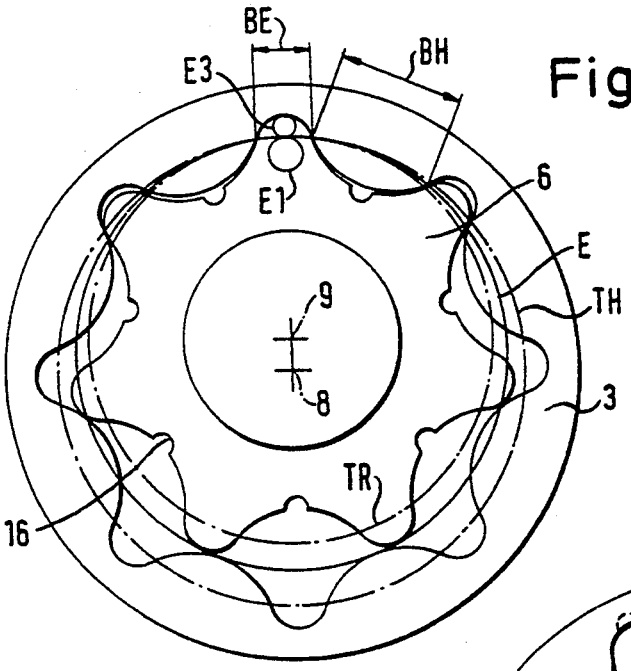
FIGS. 4 and 5 show the gears of the pump according to FIG. 1 in various revolution positions.

Also entered in FIG. 4 is the width of the pinion teeth BE measured in radians on the pinion pitch circle TR and the width BH of the internally toothed ring gear teeth measured analogously along the ring gear pitch circle TH. The theoretical engagement line E is also shown in FIG. 4. The upper part of said engagement line in FIG. 4 is reproduced again to a larger scale in FIG. 3*a*. As stated, this engagement line represents the path of the point at which the contours of the pinion teeth and the internal ring gear teeth contact each other when the gears rotate.

Figure 5:
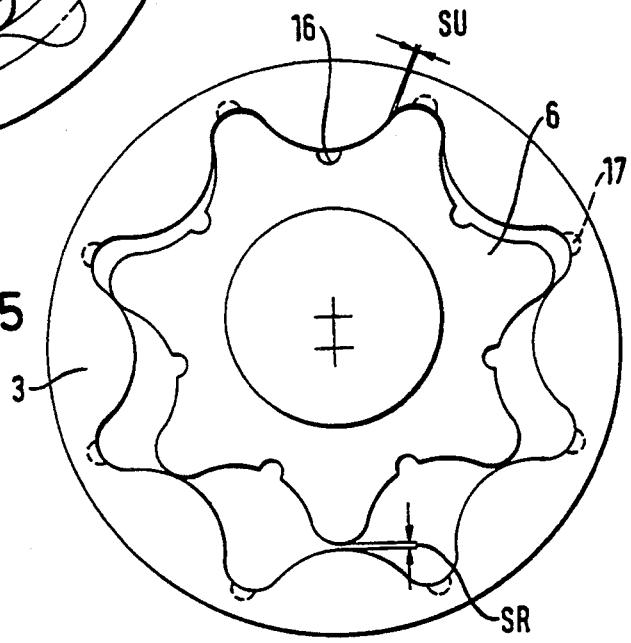

Starting from the position of the gears shown in FIG. 3*a* and FIG. 5, the engagement point is firstly at the location EO (FIG. 3*a*). From there, the engagement point moves along the semicircle E1 to the rolling point C, i.e. to the point at which the two pitch circles TH and TR are in contact along the line joining the gear centres 8 and 9. From C the engagement point moves in the direction of the arrow along the circle E3. Once the engagement point has reached the apex of said circle on the straight line through EO and C, the centre line of the pinion tooth shown on the left in FIG. 3*a* is located on the straight line EO-C. The engagement point now moves further along the left half of the circle E3 to the point C again at which the left flank of the pinion tooth shown on the left in FIG. 3*a* is now located. At the same time, the engagement point between the epicycloids of the pinion tooth head and the hypocycloids of the internal ring gear moves along the branch E2 between the two Ditch circles downwardly into the region opposite the point of deepest tooth engagement and then upwardly again to the point C (see FIG. 4).

However, the engagement line in practice, or to be more exact the path of the sealing point between two teeth, differs considerably from this theoretical profile of the engagement line, this being due to the play and the production inaccuracies.

It can also be seen in FIG. 3*a* that in the theoretical ideal case illustrated there, when the hollow gear tooth is located with its centre line on the line_connecting the centres of the two gears, there is only an exceedingly thin residual volume strip VR between the trailing tooth flank of the ring gear tooth and the driving flank of the pinion tooth with a cycloid toothing. This strip must be displaced during the following angular rotation region up to the optimum point before reaching the displacement maximum.

However, in practice gear teeth engagement is never completely without play. In particular, a relatively large play was hitherto necessary because in the region opposite the point of deepest tooth engagement in the sealing area necessary where between suction and pressure kidneys adequate tooth head clearance, in itself undesirable, must be present to ensure that no blocking and no hammering of the teeth against each other can occur. In the known cycloid toothing this running clearance at the lower sealing point in FIG. 1 also leads to an undesirably large clearance at the sealing point in the region of the deepest teeth engagement. The invention now makes it possible to have in fact only a minimum clearance at the point of deepest teeth engagement without thereby impairing the necessary relatively large tooth clearance in the region opposite the point of deepest teeth engagement. The preferred possibility for generating the flattening necessary for this purpose of the cycloids forming the teeth gap and teeth contours is shown exaggerated in FIG. 2. In the latter, the pitch circle of the gear to be corrected is designated by T. It will be assumed hereinafter that this is the pitch circle of the pinion.

Figure 2:
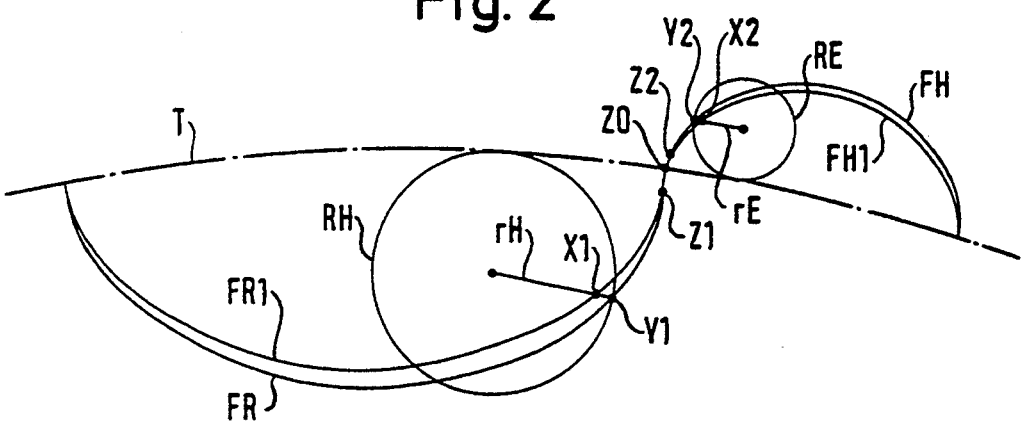
FIG. 2 shows an advantageous geometrical configuration for the flattening of the cycloids, to a larger scale.

The generating circle RH can also be seen in FIG. 2. If said circle rolls from the point Z0 on the pitch circle along the inner side of said pitch circle, the point Y1 of the periphery of the generating circle RH initially located at the point Z0 describes a cycloid FR which here defines the teeth gap of the pinion. Now, if the point describing the cycloid is shifted along the radius rH of the generating circle RH a small distance inwardly towards the centre point of the generating circle RH up to the position X1, then in the starting position in which the point Y1 is at Z0 said point X1 will be in the position Z1. If the generating circle RH now rolls on the pitch circle T to the left again the point X1 will also describe a cycloid FR1, the end point of which however is at a slight distance from the pitch circle. This distance corresponds in FIG. 2 to the distance Z1–Z0. Analogously, by rolling of the generating circle RE the epicycloid FH defining the tooth head of the pinion can be flattened. In this case, the point X2 describing the flattened cycloid FH1 is located in the starting position at Z2. In this manner the large pinion tooth bottom disposed on the left was moved radially outwardly towards the pitch circle T whilst the pinion tooth contour was flattered away from the cycloid FH radially towards the pitch circle T.

In the same manner the teeth and teeth gaps of the internal ring gear are flattened. The configuration is as just described except that the pitch circle T is then the pitch circle of the internal ring gear and the generating circle RH generates the tooth contour and the generating circle RE generates the teeth gap contour. In the configuration according to the invention the flattened cycloids start and end at a slight distance from the pitch circle T. In FIG. 2 this distance is the distance Z1–Z2. This distance can be bridged simply by a straight line because it is very small compared with the greatly exaggerated illustration of FIG. 2. Once the teeth have been devised as described above firstly an ideal toothing free from clearance in the region of the deepest tooth engagement and corresponding to FIG. 3*a* is obtained, which however opposite the region of deepest tooth engagement has a tooth clearance SR corresponding in the position of FIG. 5 to the sum of the distances Z0–Z1 and Z0–Z2. When fixing the tooth clearance in the region of deepest teeth engagement it is now no longer necessary to take account of the lack of roundness of the internal ring gear, as long as the sum of the two reductions of the tooth height of pinion and internal ring gear is large enough to prevent with certainty any metallic contact of the teeth in the region opposite the point of deepest teeth engagement. In practice, of course, the teeth of both the pinion and the hollow gear would not be flattened but only one of said two groups of teeth. That is simpler. Now, only a minimum remaining teeth clearance is in fact necessary and this is obtained in simplest manner in that either the contour of the internal ring gear or that of the pinion is taken back to an equidistant line lying one or a few hundredths of a millimetre behind the tooth contour FR1, FH1 obtained according to FIG. 2. In FIG. 5 the gear pairing thus obtained is again shown. It can be seen there that the peripheral teeth clearance SU need only be a small fraction of the clearance SR between the teeth heads in the region opposite the point of the deepest teeth engagement.

Figure 3B:
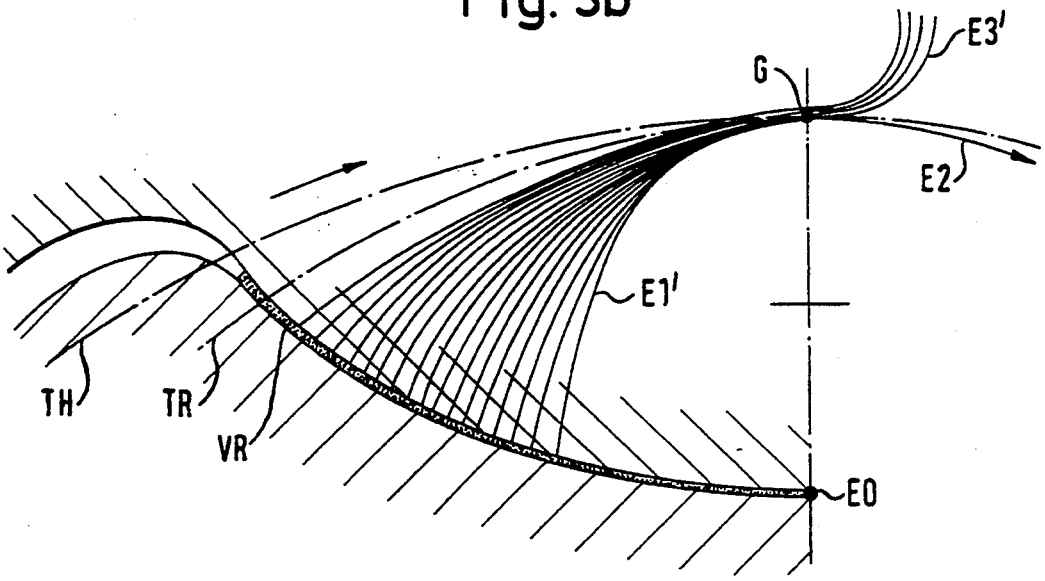
FIG. 3*b* shows a toothing having a real clearance according to the invention in the same representation as FIG. 3*a*.

FIG. 3*b* shows the toothing obtained by the invention in the same illustration as FIG. 3*a*. It can be seen here that the slight tooth clearance obtained by diminishing a tooth contour for example by one thousandth of the pitch circle diameter is filled by the liquid volume VR. The effect of the clearance thus generated or the gap thus generated between the two gears in the position shown in FIG. 3*b* is that the drive force exerted by the driven pinion is not transmitted in the point EO as in the theoretical case but distributed over a fairly large area which arises because the slight gap is filled with delivery liquid and said liquid cushion transmits the drive force over a large width. With the large teeth clearances hitherto necessary the snugness of the two teeth contours was very much poorer so that the liquid film was only over a substantially smaller width and the squeeze liquid amount was substantially larger. The contact between the driving pinion tooth and driven hollow gear tooth takes place in the invention over a large area because the thickness differences of the thin delivery liquid layer between the two teeth flanks are so small that the pressure necessary for squeezing the liquid out of the gap in FIG. 3*b* towards the left suffices to effect the torque transmission to the hollow gear. The area covered by the curve bundle E1′ shown in FIG. 3*b* has now replaced the engagement line E1 shown in FIG. 3*a*.

The situation just described for the cooperation of pinion teeth gap and ring gear tooth applies analogously to the cooperation of pinion tooth and hollow gear teeth gap. In this case the engagement line E3 becomes the engagement area E3′.

A force-transmitting tooth contact no longer takes place in the region of the engagement line portions E4 and E5 of FIG. 3*a*. This is prevented by the large tooth clearance in the revolving region outside the region of deepest teeth engagement. Only the first part of the branch E2 is retained for a short distance.

Finally, it can be seen from FIG. 3*b* that with the configuration according to the invention with minimum gap VR between the toothings in the position shown in FIG. 3 excellent sealing is also obtained because the remaining gap VR is exceedingly narrow over its entire length.

As apparent from FIGS. 2 and 4, in the invention the peripheral extent of the teeth heads 4 or teeth gaps defined by hypocycloids FR1 measured along the pitch circle T of the respective gear 3, 6 is twice as large as the corresponding extent of the teeth gaps or heads 5 defined by the epicycloids FH1. In other words, the generating circle RH described by the hypocycloids FR1 is to have a diameter approximately twice as large as that of the generating circle RE.

Another particular advantage of the invention is that with it practically no radial and tangential accelerations and retardations occur between the two gears.

It is generally true that as a rule one sixth to one third of the running clearance in the region opposite the point of deepest teeth engagement suffices for the radial running clearance, i.e. the shortening of the teeth profiles, also effective in the region of the deepest teeth engagement, to an equidistant line with respect to the cycloid or the flattered cycloid lying back one or a few hundredths of a millimetre.

Finally, it will be apparent from the above that with the clearance reduction according to the invention a particular advantage is achieved in the gear-type machine according to German patent 3,938,346, in which the toothings are mounted in each other.

As can be seen from FIG. 3*b*, in the invention the residual squeeze liquid amount, which on further rotation of the toothing from the position shown in FIG. 3*b* to a position in which the centre line of the pinion tooth on the line joining the axes, at least in the case of an oil pump, does not cover appreciably more than the thin oil film which without excessively high pressures cannot be removed from the surface at all. In other words, it is not necessary to displace hardly any further squeeze oil because the amount of oil remaining in the gap hardly exceeds in quantity the thin oil film just filling the play.

Figure 6:
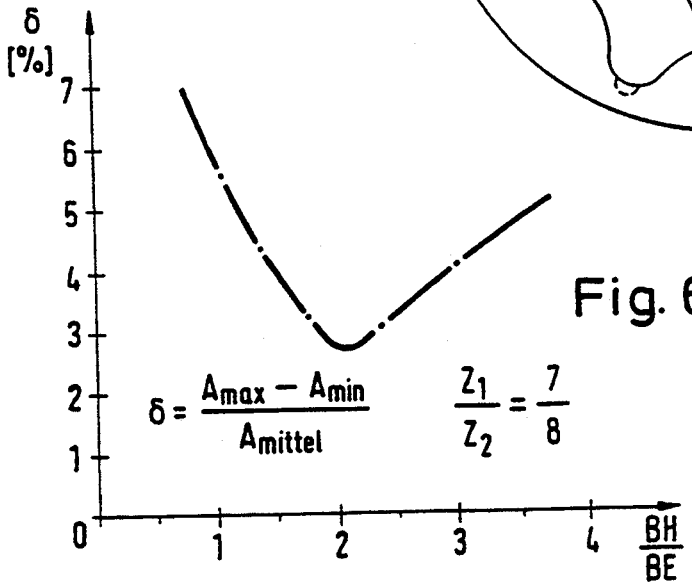
FIG. 6 shows the dependence of the irregularity of the instantaneous displacement volume on the ratio of the ring gear tooth width to the pinion tooth width for a pump having a tooth number ratio 7:8.

This quite considerably reduces the delivery flow pulsation. The different teeth head width explained above according to the invention acts in the same sense. In FIG. 6 along the abscissa the ratio of the tooth width of the hollow gear to the tooth width of the pinion is plotted, or expressed mathematically the ratio of the diameter of the generating circle generating the hypocycloids to the diameter of the generating circle generating the epicycloids. Along the ordinate the lack of uniformity of the instantaneous displacement volume A is plotted. The lack of uniformity is then given by the formula:

$$\delta = \frac{A\max - A\min}{A\text{mean}}$$

FIG. 6 shows the ratios with a teeth number ratio of 7:8 as shown in FIGS. 1, 4 and 5. FIG. 6 shows with the curve apparent therein the dependence of the lack of uniformity of the instantaneous displacement volume on the ratio of the teeth widths. With BH/BE=2 this ratio has a pronounced minimum. There, the degree of lack of uniformity is only about 2.5% whereas with equally wide teeth it is more than 5%. In this manner the teeth width ratio chosen according to the invention contributes quite considerably to a reduction of the delivery flow pulsation and this in turn reduces the noise.

To substantially reduce the development noise even at higher speeds of rotation in gear-type machines according to the invention, which are already distinguished by low noise development, in the centre of the teeth gap bottom of the pinion 6 the axial grooves 16 are provided. As apparent from the drawings, these grooves have a semicircular profile and merge angled, but not sharp-edged into the teeth gap surface of the pinion.

Now, if the gear-type machine is rotated clockwise the cavitation bubbles arising at relatively high speed of rotation in the delivery fluid collect in the grooves 16, due to centrifugal force, and they are transported there with only a slight dead space effect beyond the point of deepest teeth engagement, i.e. the rolling point C, into the suction region. Likewise, the grooves here can take up squeeze oil. As tests have shown, this results in a very considerable reduction in noise and thus also a corresponding improvement in efficiency.

Analogous grooves can also be provided in the teeth gap bottom of the internal ring gear at 17 for receiving squeeze oil. These grooves are indicated in dashed line in FIG. 5.

It is claimed:

1. A gear-type machine comprising a housing containing a gear chamber having inlet and outlet openings;

an internally toothed ring gear arranged in said gear chamber and an externally toothed pinion which is rotatably arranged within said ring gear in the housing and which has one tooth less than said ring gear, meshes with said ring gear and on rotation of said pinion and said ring gear forms, between said teeth of said pinion and said teeth of the ring gear, expanding and diminishing fluid cells which conduct fluid from said inlet to said outlet;

said teeth of said pinion having heads and said teeth of said ring gear having gaps between said pinion teeth and said ring gear teeth; said teeth heads of said pinion and said teeth gaps of said ring gear having the form of epicycloids formed by rolling of a first generating circle on a pitch circle of said pinion and said ring gears;

said teeth gaps of said pinion and said teeth heads of said ring gear having the form of hypocycloids formed by rolling a second generating circle on said pitch circle of said pinion and said ring gear;

the radius of said first generating circle being different to the radius of said second generating circle, wherein a peripheral extent of said pinion teeth gaps defined by said hypocycloids and said ring gear teeth, measured on said pitch circle is 1.5 time to 3 times larger than a peripheral extent of said pinion teeth defined by said epicycloids, measured on said respective pitch circle; and at least one of said epicycloids and said hypocycloids are flattened towards a center of a respective pitch circle of said epicycloid and said hypocycloid, respectively, to such an extent that said flattenings corresponds to a radial clearance between the teeth heads in the region opposite the point of deepest teeth engagement and said gears mesh with each other with a less clearance at the point of deepest teeth engagement, said cycloids of one of said hypocycloids and said epicycloids is flattened whilst the flattening of the cycloids of the other group is equal to zero, said flattening of said cycloids is effected by a slight radial displacement of said cycloids from a periphery of said generating circle of said cycloids in the direction towards the centre of said generated circle.

2. A gear-type machine according to claim 1, wherein said peripheral extent of said pinion teeth gaps and said ring gear teeth is 1.75 times to 2.25 times larger than said peripheral extent of said pinion teeth and said ring gear teeth gaps.

3. A gear type machine according to claim 1, wherein said peripheral extent of said pinion teeth gaps and said ring gear teeth is two times larger than said peripheral extent of said pinion teeth and said ring gear teeth gaps.

4. A gear-type machine according to claim 1, wherein the epicycloids are flattened.

5. A gear-type machine according to claim 1, wherein a starting point and an end point of each flattened cycloid is connected by a straight line with a starting and end point respectively of the original unflattened cycloids on the pitch circle.

6. A gear-type machine according to claim 1, wherein said flattening or the sum of two cycloid flattenings measured in the cycloid centre is the 2000th to 500th part of the diameter of the pitch circle of said ring gear.

7. A gear-type machine according to claim 1, wherein a minimum teeth flank clearance necessary at a point of deepest teeth engagement is established by an equidistant reduction of the contour of the teeth of said pinion and said ring gear.

8. A gear-type machine according to claim 1, wherein said pinion has 7 to 11 teeth.

9. A gear-type machine according to claim 1, wherein in said bottom of said teeth, at least at said bottom of said pinion teeth, are narrow axial grooves.

10. A gear-type machine according to claim 9, wherein said grooves are one quarter to one sixth as wide as a periphery of said generating circle generating said teeth gap.

11. A gear-type machine according to claim 9, wherein said grooves are 2 to 3 times as wide as said grooves are deep.

* * * * *